US012497150B1

(12) United States Patent
Oliverio et al.

(10) Patent No.: US 12,497,150 B1
(45) Date of Patent: Dec. 16, 2025

(54) TROLLING MOTOR STEERING UNITE

(71) Applicants: John D Oliverio, Brandon, FL (US); Nicholas A. Vicari, Tampa, FL (US)

(72) Inventors: John D Oliverio, Brandon, FL (US); Nicholas A. Vicari, Tampa, FL (US)

(73) Assignee: ILIMARINE SYSTEMS, INC

( * ) Notice: Subject to any disclaimer, the term of this patent is extended or adjusted under 35 U.S.C. 154(b) by 428 days.

(21) Appl. No.: 18/445,052

(22) Filed: Mar. 20, 2023

(51) Int. Cl.
*B63H 20/12* (2006.01)
*B63H 20/00* (2006.01)

(52) U.S. Cl.
CPC ..... *B63H 20/12* (2013.01); *B63H 20/007* (2013.01)

(58) Field of Classification Search
CPC ..... B63H 20/12; B63H 20/007
See application file for complete search history.

(56) References Cited

U.S. PATENT DOCUMENTS

2009/0253317 A1* 10/2009 Wong ..... B63H 20/12 440/53
2023/0102255 A1* 3/2023 Crawford ..... B63H 20/12 440/61 R

FOREIGN PATENT DOCUMENTS

EP 2398698 B1 * 6/2013 ..... B63H 25/42

* cited by examiner

*Primary Examiner* — Stephen P Avila
(74) *Attorney, Agent, or Firm* — Arthur W. Fisher, III

(57) ABSTRACT

A trolling motor steering unit to control rotation of a propulsion support shaft and direction of thrust of a lower propulsion unit including a steering motor, a shaft sleeve to receive the propulsion support shaft therethrough and a multi-stage planetary gear assembly driven by the steering motor to engage and rotate the shaft sleeve to rotate the propulsion support shaft and lower propulsion unit.

11 Claims, 5 Drawing Sheets

TROLLING MOTOR STEERING UNITE

BACKGROUND OF THE INVENTION

Field of the Invention

A trolling motor steering unit to control the rotation of a propulsion support shaft and direction of thrust of a propulsion unit.

Description of the Prior Art

Generally, small electric outboard motor assemblies mounted to the bow or transom of a boat are used for slow speed maneuverability and positioning of fishing boats. An electric motor disposed within a lower housing is coupled to a thruster or propeller. The direction and speed of such electric outboard motor assemblies may be controlled by a foot control or remote control.

In addition to the numerous examples of prior art well known in the industry, the following patents disclose electric trolling motors.

U.S. Pat. No. 4,092,946 relates to an electric motor for trolling comprising an elongated and generally cylindrical submersed unit which houses an electric motor that in turn drives a planetary gear system to drive the propeller.

U.S. Pat. No. 4,009,677 describes an electric trolling motor includes a lower unit with a cylindrical motor housing closed at the aft end by a planetary gear-reduction subassembly. Planetary gears carried by a cage engage the annular gear. A propeller shaft is fixed to the cage and journaled in a second hub portion of the housing. A sun gear meshes with the planetary gears and has an opening aligned with an opening in a hub portion of the first hub member to receive the motor shaft. Spherical seats provide proper alignment of the shafts. The planetary gear subassembly drops onto the motor shaft with both hub members abutting the motor housing and secured thereto by bolts. The motor shaft and sun gear have complementing interlocking surfaces to establish rotatable interconnection. The opposing surfaces of the sun gear and the cage have thrust bearing surfaces with the motor shaft holding the sun gear in cage abutting relation.

While some of the prior art may contain some similarities relating to the present invention, none of them teach, suggested or include all of the advantages and unique features of the invention disclosed hereafter.

SUMMARY OF THE INVENTION

The present invention relates to a trolling motor steering unit to control rotation of a propulsion support shaft and the direction of thrust of a propulsion unit.

The trolling motor steering unit comprises a direct current reversible steering motor coupled to a rotatable carriage sleeve to receive a portion of the propulsion support shaft therethrough to selectively drive a multi-stage planetary gear assembly. Of course, the trolling motor steering unit may comprise a single stage planetary assembly.

The multi-stage planetary gear assembly comprises a first or lower stage of gears and a second or upper stage of gears together with a stationary ring gear, a first or lower carriage disposed between the first or lower stage of gears and the second or upper stage of gears and a second or upper carriage disposed above the second or upper stage of gears.

The first or lower stage of gears comprise a first or lower sun gear coupled to the steering motor and disposed to engage a plurality of first or lower planet gears. The first or lower carrier is coupled to the plurality of first or lower planet gears. Thus the direct current reversible steering motor drives or rotates the first or lower sun gear to drive or rotate the plurality of first or lower planet gears to rotate the first or lower carriage.

The second or upper stage of gears comprises a second or upper sun gear connected to the first or lower carriage such that the first or lower planet gears and first or lower carriage drive or rotate the second or upper sun gear. The second or upper sun gear is disposed to engage each of a plurality of second or upper planet gears. The second or upper carriage affixed to the rotatable carriage sleeve is coupled to the plurality of second or upper planet gears such that first or lower carriage drives or rotates the second or upper sun gear that drives or rotates the second or upper planet gears to rotate the second or upper carriage to rotate the rotatable carriage sleeve to rotate the propulsion support shaft.

The stationary sun gear is disposed to engage both the first or lower planet gears and the second or upper planet gears.

This Summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
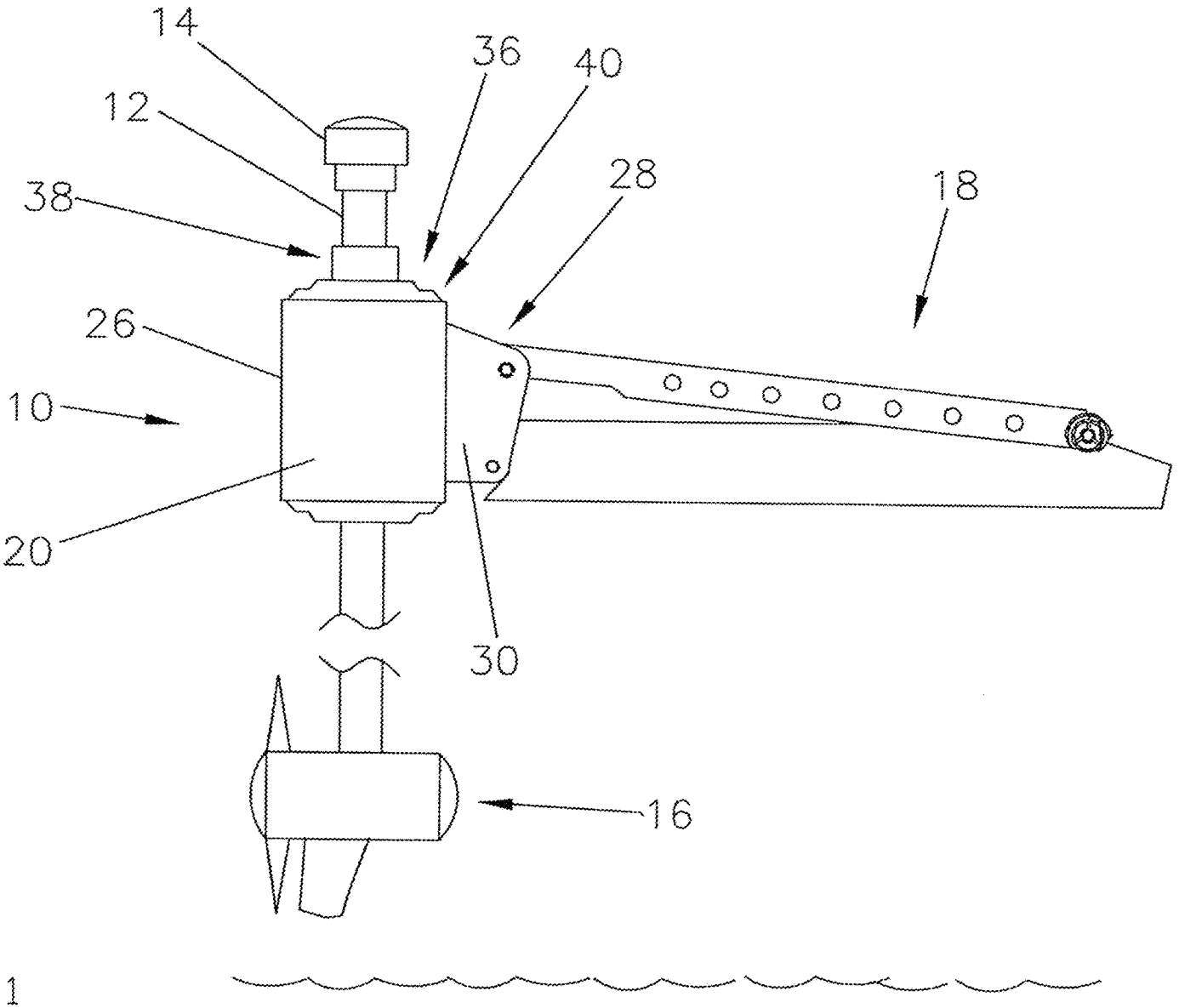
FIG. 1 is a side view of the trolling motor steering unit of the present invention.

As shown in FIG. 1, the present invention relates to a trolling motor steering unit generally indicated as 10 to control rotation of a propulsion support shaft 12 having a navigation module 14 mounted to the upper portion thereof and to control the direction of thrust of a propulsion unit generally indicated as 16. The trolling motor steering unit 10, propulsion support shaft 12, navigation module 14 and propulsion unit 16 including an electric thrust motor are coupled to a boat (not shown) by a deployment mechanism generally indicated as 18.

Figure 2:
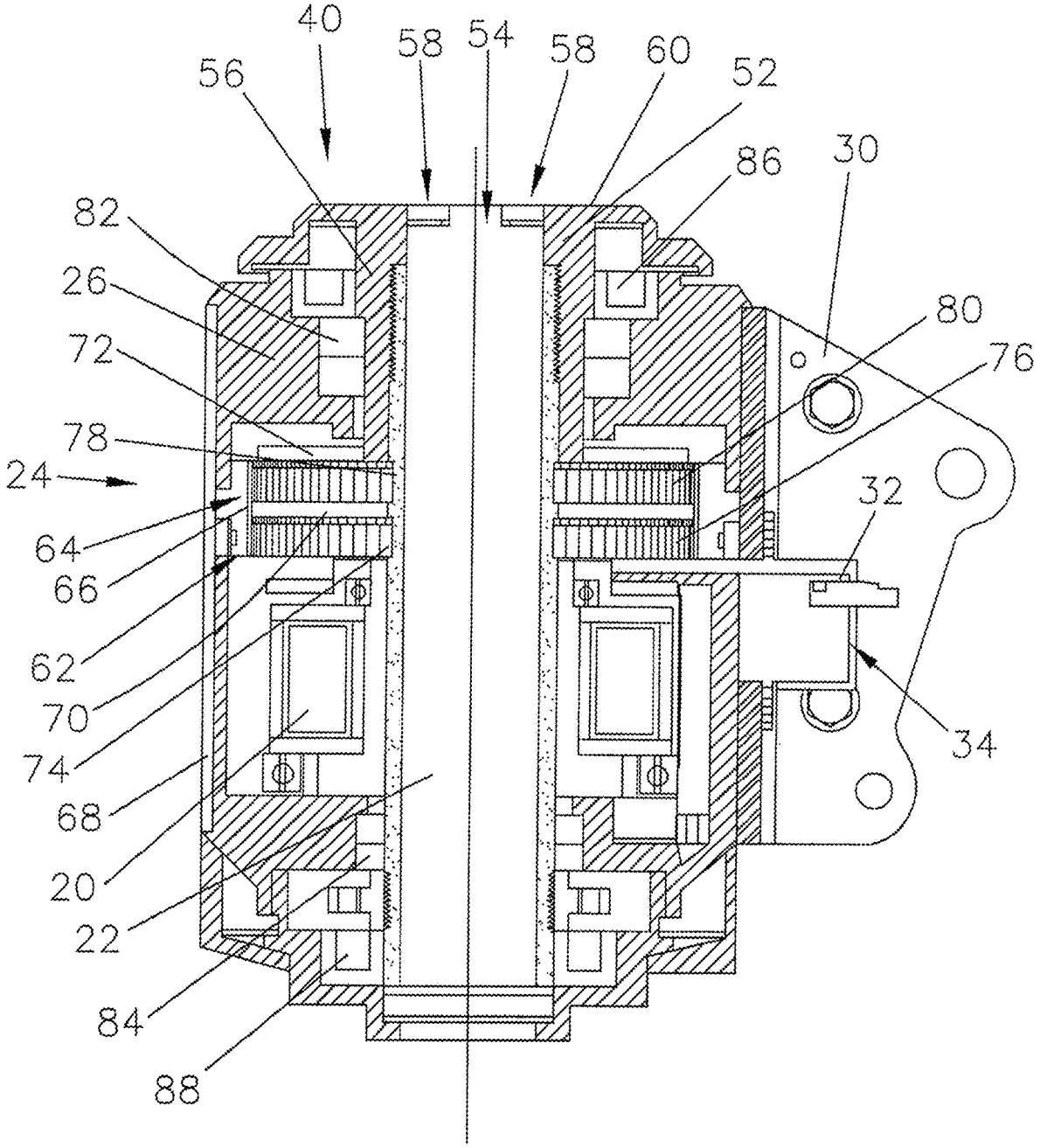
FIG. 2 is a detailed cross-sectional side view of the trolling motor steering unit of the present invention.
Figure 3:
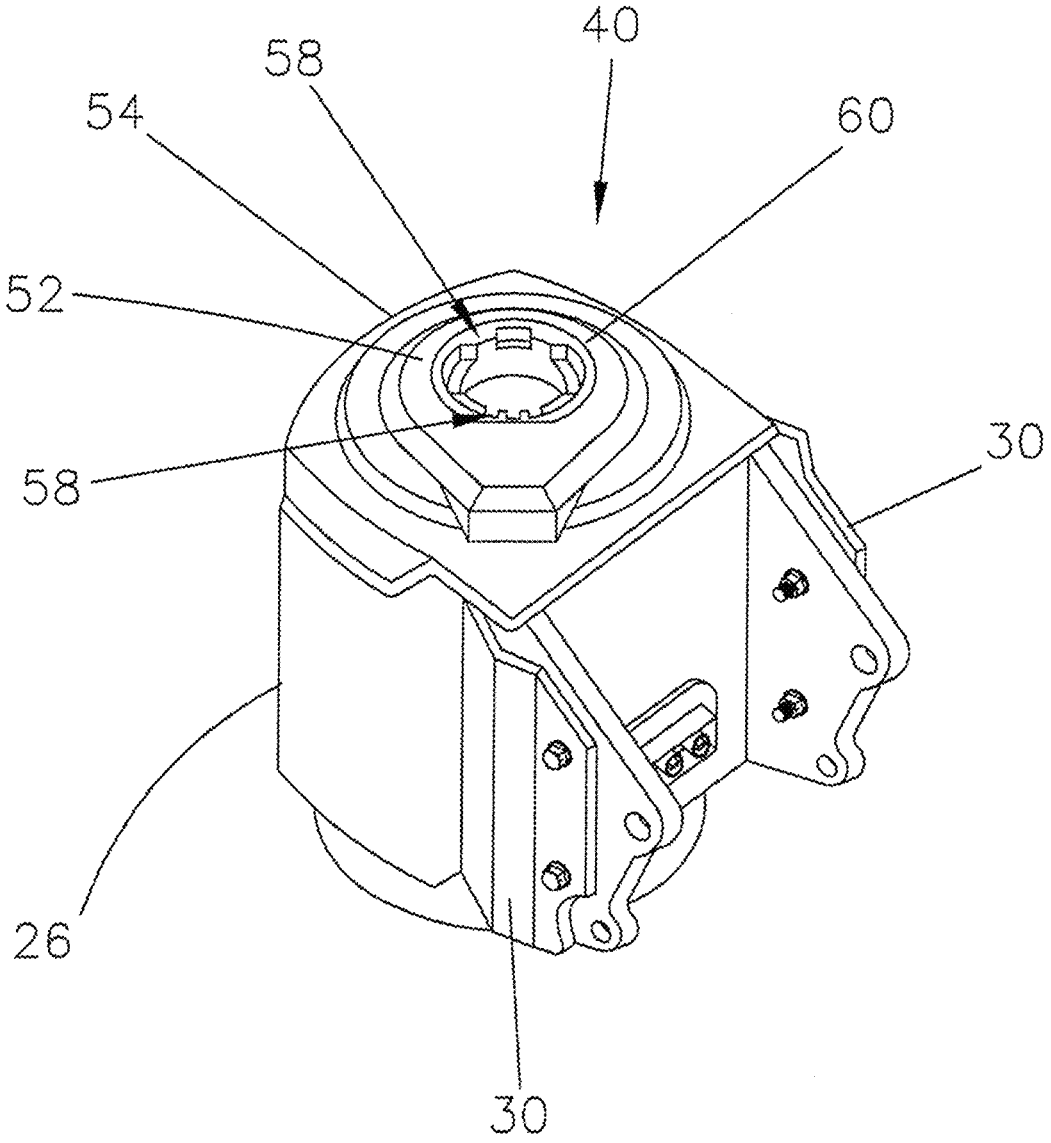
FIG. 3 is a perspective view of the coupling assembly of the present invention.
Figure 3A:
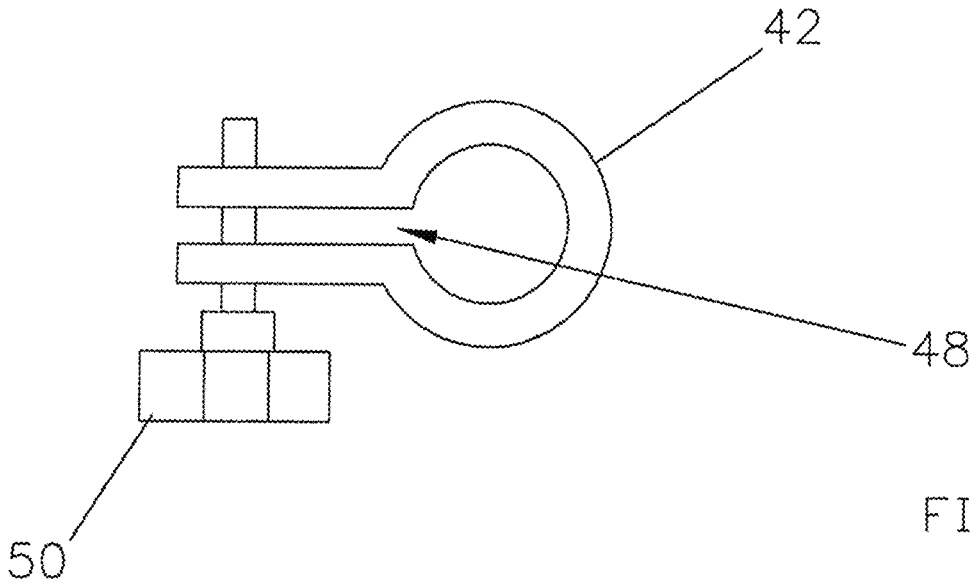
FIG. 3A is a top view of the upper clamp of the present invention.
Figure 3B:
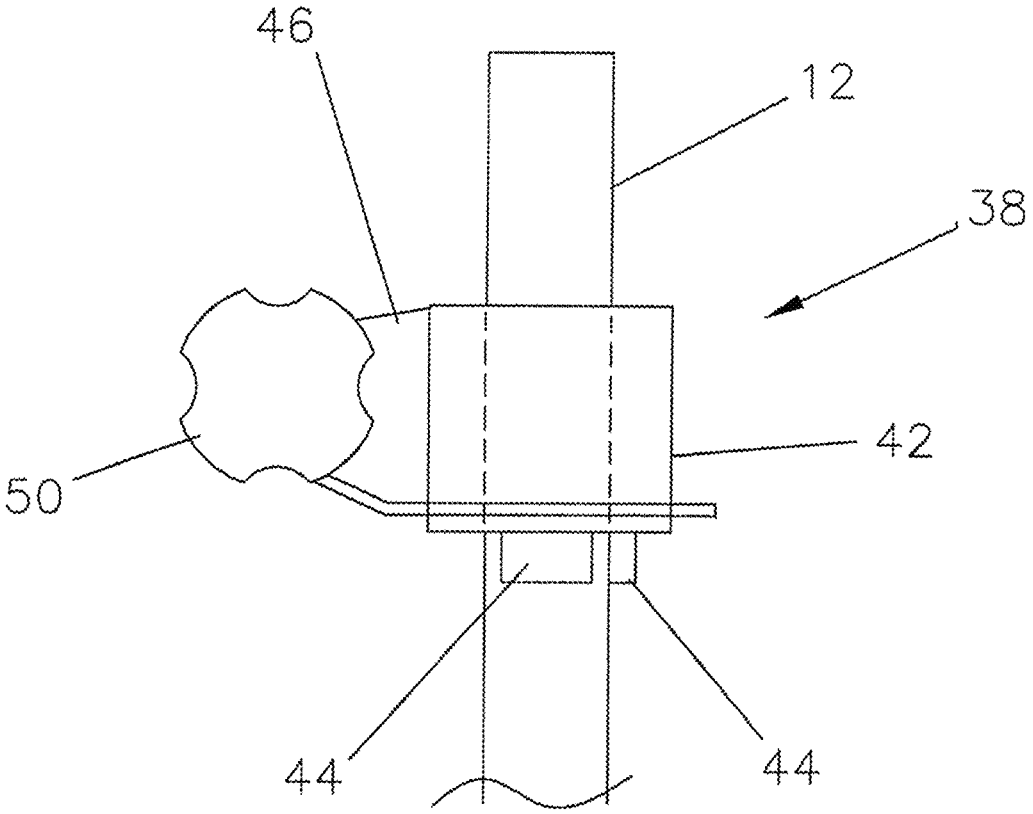
FIG. 3B is a side view of the upper clamp of the coupling assembly of the present invention.

As shown in FIG. 2, the trolling motor steering unit 10 comprises a direct current reversible steering motor 20 such as a stepper motor coupled to a rotatable carriage sleeve 22 to receive a portion of the propulsion support shaft 12 therethrough to selectively drive a multi-stage planetary gear assembly generally indicated as 24 disposed within a housing 26. Of course, the trolling motor steering unit 10 may comprise a single stage planetary assembly.

As shown in FIG. 1, housing 26 is attached to the deployment mechanism 18 by a mounting bracket generally indicated as 28 comprising a pair of substantially parallel mounting plates each indicated as 30.

As shown in FIG. 2, the steering motor 20 is connected to a power source (not shown) through a steering driver printed circuit board (PCB) 32 disposed within a steering printed circuit board (PCB) housing 34. Portions of the propulsion support shaft 12 and rotatable carriage sleeve 22 are rotatably disposed within an aperture or hole 35 formed in the center of an inner fixed element of the steering motor 20.

As shown in FIG. 1, the trolling motor steering unit 10 is attached to the propulsion support shaft 12 by a coupling assembly generally indicated as 36. As shown in FIGS. 1 through 3B, the coupling assembly 36 comprises an upper clamp generally indicated as 38 and a rotatable lower housing cap or cover generally indicated as 40. The upper clamp 38 comprises a split ring 42 mounted on the propulsion support shaft 12 having at least one interlocking member or key 44 extending downwardly therefrom and a pair of flanges or connectors 46 extending outwardly from a space or opening 48 formed in the split ring 42. A thumb screw 50 or similar fastener connects the flanges or connector 46 to selectively secure the upper clamp 38 to the propulsion support shaft 12 by tightening the flanges or connectors 46 together. The rotatable lower housing cap or cover 40 comprises a substantially circular member or disk 52 including a centrally disposed aperture 54 to receive a portion of the propulsion support shaft 12 therethrough and having an annular sleeve or member 56 extending downwardly therefrom to secure the rotatable lower housing cap or cover 40 to the rotatable carriage sleeve 22. At least on recess or keyway 58 is formed in the upper surface 60 of the substantially circular member or disk 52 to receive a corresponding interlocking member or key 44 of the upper clamp 38 to couple the rotatable carriage sleeve 22 to the propulsion support shaft 12.

Figure 4:
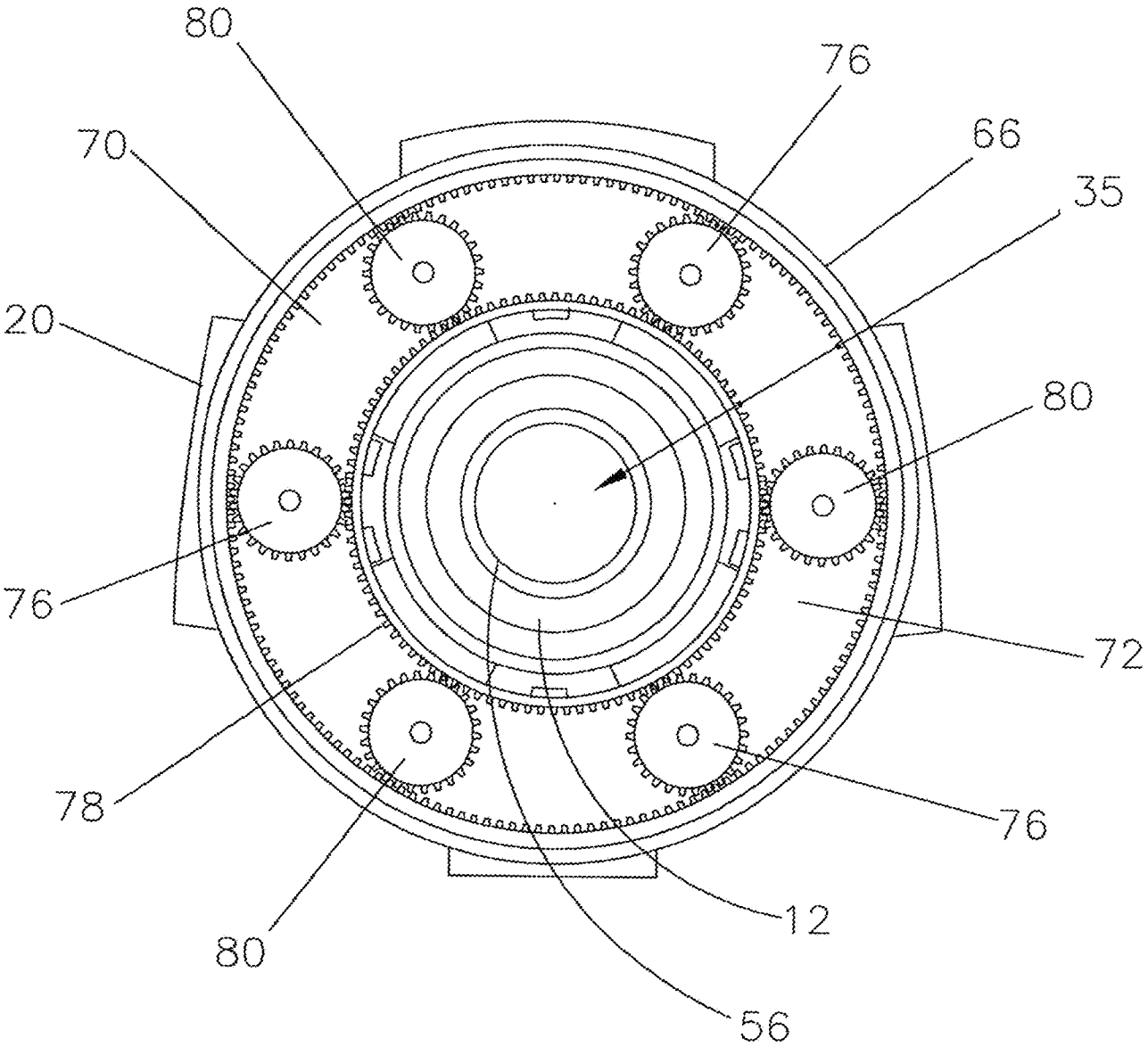
FIG. 4 is a detailed cross-sectional top view of the trolling motor steering unit of the present invention.

As shown in FIGS. 2 and 4, the multi-stage planetary gear assembly 24 comprises a first or lower stage of gears generally indicated as 62 and a second or upper stage of gears generally indicated as 64 together with a stationary ring gear 66 affixed to the interior wall 68 of the housing 26, a first or lower carriage 70 disposed between the first or lower stage of gears 62 and the second or upper stage of gears 64, and a second or upper carriage 72 disposed above the second or upper stage of gears 64. The second or upper stage of gears 64 further reduces the overall gear reduction from the direct current reversible steering motor 20 to the rotatable carriage sleeve 22.

As shown in FIGS. 2 and 4, the first or lower stage of gears 62 comprises a first or lower sun gear 74 coupled to an outer rotating element or member of the steering motor 20 and disposed to engage a plurality of first or lower planet gears each indicated as 76. The first or lower carrier 70 is coupled to the plurality of first or lower planet gears 76. Thus the direct current reversible steering motor 20 drives or rotates the first or lower sun gear 74 to drive or rotate the plurality of first or lower planet gears 76 to rotate the first or lower carriage 70.

As shown in FIGS. 2 and 4, the second or upper stage of gears 64 comprises a second or upper sun gear 78 connected to the first or lower carriage 70 such that the first or lower planet gears 76 and first or lower carriage 70 drive or rotate the second or upper sun gear 78. The second or upper sun gear 78 is disposed to engage each of a plurality of second or upper planet gears each indicated as 80. The second or upper carriage 72 affixed to the rotatable carriage sleeve 22 is coupled to the plurality of second or upper planet gears 80 such that first or lower carriage 70 drives or rotates the second or upper sun gear 78 that drives or rotates the second or upper planet gears 80 to rotate the second or upper carriage 72 to rotate the rotatable carriage sleeve 22 to rotate the propulsion support shaft 12.

The stationary ring gear 66 is disposed to engage both the first or lower planet gears 76 and the second or upper planet gears 80.

Upper and lower bearings 82 and 84 respectively engage the outer surfaces of the annular sleeve or member 56 and rotatable carriage sleeve 22; while, upper and lower shaft seals 86 and 88 seal the upper and lower portions of the housing 26.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of this description.

What is claimed is:

1. A trolling motor steering unit including a reversible steering motor coupled to a rotatable carriage sleeve to control rotation of a propulsion support shaft and direction of thrust of a lower propulsion unit, said rotatable carriage sleeve being disposed to receive said propulsion support shaft therethrough and a multi-stage planetary gear assembly driven by said reversible steering motor to engage and rotate said rotatable carriage sleeve to rotate said propulsion support shaft and said lower propulsion unit, said multi-stage planetary gear assembly comprises a lower state of gears and an upper stage of gears together with a stationary ring gear, a lower carriage disposed between said lower stage of gears and said upper stage of gears.

2. The trolling motor steering unit of claim 1 where said lower stage of gears comprises a lower sun gear coupled to said reversible steering motor and disposed to engage a plurality of lower planet gears, said lower carrier being coupled to said plurality of lower planet gears such that said reversible steering motor drives or rotates said lower sun gear to drive or rotate said plurality of lower planet gears to rotate said lower carriage and said upper stage of gears comprises an upper sun gear connected to said lower carriage such that said lower planet gears and lower carriage drive or rotate said upper sun gear, said upper sun gear is disposed to engage each of a plurality of said upper planet gears, said upper carriage affixed to said rotatable carriage sleeve coupled to said plurality of upper planet gears such that said lower carriage drives or rotates said upper carriage to rotate said rotatable carriage sleeve to rotate said propulsion support shaft.

3. The trolling motor steering unit of claim 2 wherein said stationary ring gear is disposed to engage both said lower planet gears and upper planet gears.

4. A trolling motor steering unit to control rotation of a propulsion support shaft to control the direction of thrust of a propulsion unit comprising a reversible steering motor coupled to a rotatable carriage sleeve to receive a portion of the propulsion support shaft therethrough to selective drive a multi-stage planetary gear assembly, said multi-stage planetary gear assembly comprises a lower stage of gears and an upper stage of gears with a stationary ring gear affixed to an interior wall of the housing, a lower carriage disposed between said lower stage of gears and said upper stage of gears, and an upper carriage disposed above said upper stage of gears to further reduce the overall gear reduction from said reversible steering motor to said rotatable carriage sleeve, said lower stage of gears comprises a lower sun gear coupled to an outer rotating element or member of said reversible steering motor and disposed to engage a plurality of lower planet gears wherein said lower carrier is coupled to said plurality of lower planet gears such that said reversible steering motor drives or rotates said lower sun gear to drive or rotate said plurality of lower planet gears to rotate said lower carriage, said upper stage of gears comprises an upper sun gear connected to said lower carriage such that said lower planet gears and said lower carriage drive to rotate said upper sun gear, said upper sun gear being disposed to engage each of a plurality of upper planet gears, said upper carriage being affixed to said rotatable carriage sleeve coupled to said plurality of upper planet gears such that said lower carriage drives or rotates said upper sun gear that drives or rotates said upper planet gears to rotate said upper carriage to rotate said rotatable carriage sleeve to rotate said propulsion support shaft, said stationary ring gear being disposed to engage both said lower planet gears and said upper planet gears.

5. A trolling motor steering unit including a reversible steering motor coupled to a rotatable carriage sleeve to control the rotation of a propulsion support shaft and directional thrust of a lower propulsion unit, said rotatable carriage sleeve being disposed to receive said propulsion support shaft therethrough and a multi-state planetary gear assembly driven by said reversible steering motor to engage and rotate said rotatable carriage sleeve to rotate said propulsion support shaft and said lower propulsion unit wherein said multi-stage planetary gear assembly comprises a lower stage of gears and an upper stage of gears together with a stationary ring gear, a lower carriage disposed between said lower stage of gears and said upper of gears and an upper carriage disposed above said upper stage of gears.

6. The lower stage of gears of claim 5 wherein said lower stage of gears comprises a lower sun gear coupled to an outer rotating element or member of said reversible steering motor being disposed to engage a plurality of lower planet gears, said lower carrier being coupled to said plurality of lower planet gears such that said reversible steering motor drives or rotates said lower sun gear to drive or rotate said plurality of lower planet gears to rotate said lower carriage.

7. The upper stage of gears of claim 6 wherein said upper stage of gears comprises an upper sun gear coupled to said lower carriage such that said lower planet gears and said lower carriage drive or rotate said upper sun gear, said upper sun gear being disposed to engage each of a plurality of said upper planet gears.

8. The upper stage of gears of claim 7 wherein said upper sun gear is coupled to said lower carriage such that lower planet gears and said lower carriage drive or rotate said upper sun gear, said upper sun gear being disposed to engage a plurality of said upper planet gears.

9. The upper stage of gears of claim 5 wherein said upper sun gear is coupled to said lower carriage such that said lower planet gears and said lower carriage drive or rotate said upper sun gear, said upper sun gear being disposed to engage a plurality of said upper planet gears.

10. The multi-stage planetary gear assembly of claim 9 wherein said upper sun gear coupled to said or lower carriage such that said planet gears and said first carriage drive or rotate said upper sun gear, said upper sun gear being disposed to engage each of a plurality of said upper planet gears.

11. The multi-stage planetary gear assembly of claim 5 wherein said stationary ring gear being coupled to an interior of said housing and being disposed to engage both the first or lower planet gears and the second or upper planet gears.

* * * * *